US006547672B1

(12) United States Patent
Chough

(10) Patent No.: US 6,547,672 B1
(45) Date of Patent: Apr. 15, 2003

(54) PRACTICE GOLF PUTTER

(76) Inventor: Brian Chough, 333 S. Westminster Ave., #404, Los Angeles, CA (US) 90020

( * ) Notice: Subject to any disclaimer, the term of this patent is extended or adjusted under 35 U.S.C. 154(b) by 0 days.

(21) Appl. No.: 09/650,113

(22) Filed: Aug. 29, 2000

(51) Int. Cl.[7] ..... A63B 69/36

(52) U.S. Cl. ..... 473/230; 473/242; 473/340

(58) Field of Search ..... 473/131, 324, 473/230, 248, 296, 307, 242, 340; 33/449, 508; 273/129 M

(56) References Cited

U.S. PATENT DOCUMENTS 1,697,846 A * 1/1929 Anderson
1,946,134 A * 2/1934 Dyce
2,255,332 A * 9/1941 Russell
2,300,043 A * 10/1942 Carney
2,426,274 A * 8/1947 Kramer
3,044,781 A * 7/1962 Murphy
3,214,170 A * 10/1965 Warnock
3,220,730 A * 11/1965 Fine
3,319,964 A * 5/1967 Steinberg
3,377,065 A * 4/1968 White
3,680,868 A * 8/1972 Jacob
3,712,652 A * 1/1973 Uilkema
3,733,739 A * 5/1973 Terzian
4,535,992 A * 8/1985 Slagle
4,688,799 A * 8/1987 Johnson
4,756,535 A * 7/1988 Bradley
5,207,721 A * 5/1993 Lobdell
5,244,205 A * 9/1993 Melanson
5,301,704 A * 4/1994 Brown
5,577,965 A * 11/1996 Burgess
5,590,890 A * 1/1997 Rosso

* cited by examiner

*Primary Examiner*—Sebastiano Passaniti
(74) *Attorney, Agent, or Firm*—Jerry H. Noh

(57) ABSTRACT

A practice putter for improving a golfer's putting game having a conventional grip attached to a conventional shaft. The shaft is connected to a head having a concave bottom surface of a predetermined radius. One or more balls are mounted in the bottom surface on an axle, and each ball revolves freely only in the direction of the axle. Each ball is positioned adjacent opposed sides of the concave middle portion. Each ball is mounted on an axle having a shock system that allows the ball to be pushed inward towards the head with the application of a predetermined force thereon. The length of the shaft is adjustable, and the angle determined by the top surface of the head and the shaft is also adjustable. In proper use, each ball is made to contact the putting surface as the head is moved in a straight line guided by the rolling balls.

14 Claims, 2 Drawing Sheets

PRACTICE GOLF PUTTER

BACKGROUND OF THE INVENTION

I. Field of the Invention

This invention pertains to a golf putter. More specifically, the invention concerns a practice golf putter for improving a golfer's putting stroke.

II. Description of the Prior Art

A conventional golf putter typically includes a shaft and a head having a flat hitting surface. The head and shaft are arranged whereby a right-handed user would hit the ball with a conventional swing from right to left. The conventional design of putters positions the bottom edge of the hitting surface at ground level. There is a tendency for the ground to interfere with a desired stroke if contact is made with the ground. Thus when putting on a green, the user typically raises the putter slightly so that the hitting surface does not touch the putting surface usually referred to as the green. Many different types of golf putters have been developed for improving one's putting stroke.

One such golf putter is U.S. Pat. No. 5,207,721 issued to Lobdell. Lobdell teaches a putter having an elongated head with an axle adapted for supporting a pair of coaxial rotatable wheels. The wheels are used to roll the putter in the direction of a sight line extending outwardly from the shaft. The hitting surface has a convex radius and the ball is stroked by pushing the shaft toward the ball. A disadvantage of this putter is that a user cannot utilize the conventional left to right putter swing with this putter.

Another putter is U.S. Pat. No. 4,688,799 issued to Johnson which teaches a putter having a rotatable circular roller mounted on either the toe or the heel of the golf club. The roller prevents friction with the ground by raising the head so that the hitting surface does not touch the green in a stroke. A disadvantage, however, is that the single roller does not improve the straightness of one's putting stroke.

Another putter is U.S. Pat. No. 3,319,964 issued to Steinburg. Steinburg teaches a practice putter having an axle extending across the head parallel to the hitting surface and having a rotatable wheel on each end of the axle. The wheel raises the hitting surface above the green and allows straight putting strokes. A disadvantage is that the putter head is raised above the ground at the level according to the radius of the wheel. As such, the practice putter is disadvantageous in teaching the user to develop a putting stroke having an ideal spacing between the head and the green.

None of the prior art teaches an improved putter as taught by the present invention.

Thus, it is a primary objective of the present invention to provide a practice putter which can improve a golfer's ability to determine the level of height above the ground to hold his putter in a putting stroke. It is another objective of the present invention to provide a practice putter which can improve a golfer's ability to develop a straight putting stroke. Another objective of the present invention is to provide a practice putter which can be adjusted to be similar to a golfer's regular putter.

SUMMARY OF THE INVENTION

The present invention is a practice putter for improving a golfer's putting game. The golfer first uses the practice putter of the present invention to develop his putting stroke. The golfer can use the same putting stroke used with the practice putter using his own game putter to maximize the accuracy of his putts.

To assist the golfer in switching from the practice putter to the game putter, the practice putter emulates many of the standard features of conventional putters. The practice putter has a conventional grip attached to a conventional shaft. The shaft is connected to a head having a bottom surface, top surface, and one or more hitting surface orthogonal to the top surface. The head-shaft angle is the angle formed by the top surface of the head and the shaft. Different golf clubs have varying head-shaft angles. Also, the length of the putters differs among various putters. It is important that the head-shaft angle and length of the practice putter closely resemble that of a golfer's game putter. Thus, both the length of the shaft and the head-shaft angle of the practice putter are adjustable.

In a putting stroke, it is important to maintain the head at a constant level of height above the putting green. Furthermore, the putting stroke should be a straight sweeping motion. To assist the golfer develop this motion, the head comprises at least two balls mounted in the bottom surface, which protrudes outwardly therefrom. Each ball is mounted on an axle so that it revolves only in the direction perpendicular to the hitting surface. Also, each ball is mounted to move inwardly with the application of a predetermined amount of pressure thereon by a shock system. Furthermore, the bottom surface of the head has a concave middle portion and, each ball is preferably positioned adjacent the opposed ends of the concave middle portion. To use the practice putter properly, the bottom surface of each ball must be touching the putting surface at all times as the head is rolled along the green in a straight line toward the target golf ball. The middle portion is concave at a predetermined radius so that the hitting surface will ideally strike the center of mass of the golf ball when the practice putter is used properly.

BRIEF DESCRIPTION OF THE DRAWING

With the above and additional objects and advantages in view, as will hereinafter appear, this invention comprises the devices, combinations and arrangements of parts hereinafter described, by way of example, and illustrated in the accompanying drawings of a preferred embodiment in which.

DESCRIPTION OF THE PREFERRED EMBODIMENT

Figure 1:
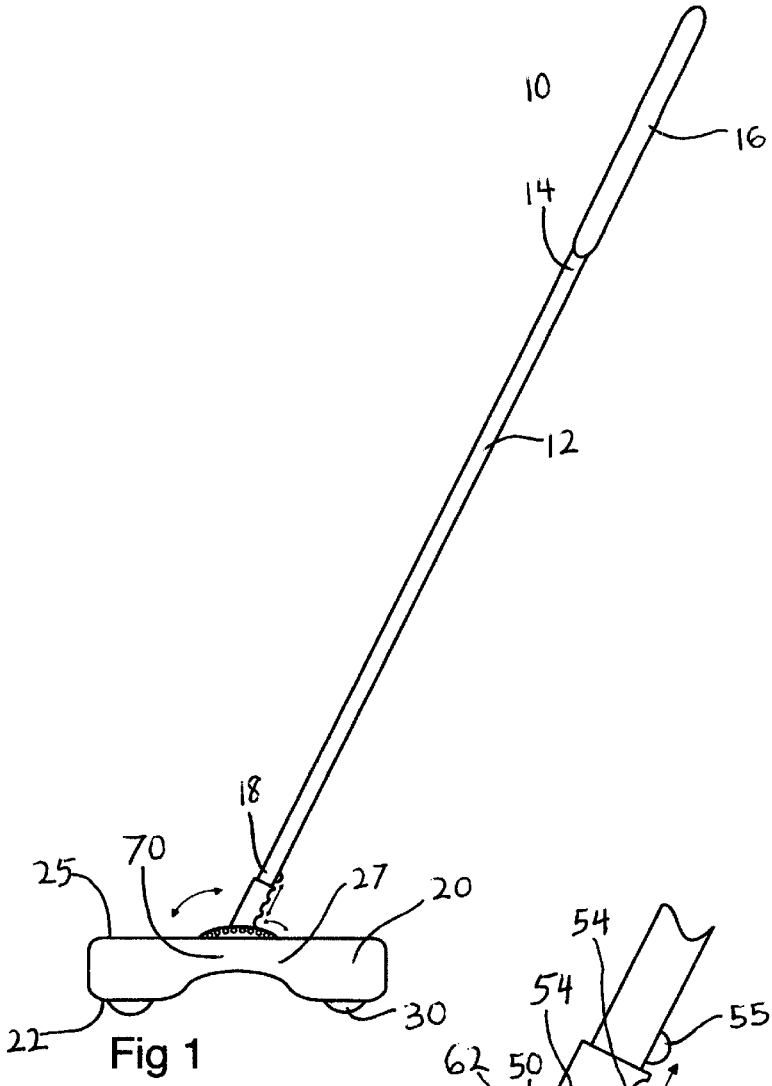
FIG. 1 is a side view of the putter of the present invention.
Figure 4:
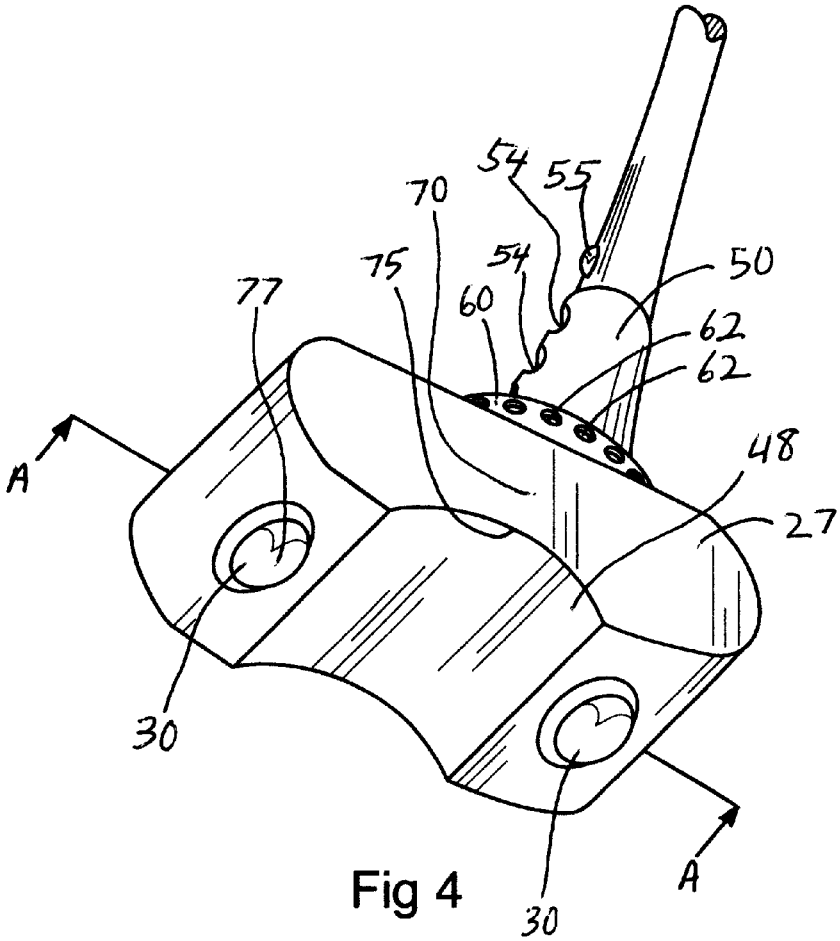
FIG. 4 is a perspective view of the head and shaft portion of the present invention.

FIG. 1 shows the putter 10 of the present invention. The putter 10 comprises a shaft 12 of the conventional shape and has a first end 14 attached to a grip 16 and a second end 18 attached to a head 20. The head 20 has a bottom surface 22, top surface 25, and one or more hitting surface 27 orthogonal to the top surface 25. When striking a golf ball (not shown), the hitting surface 27 is used to make contact with the golf ball. The head 20 comprises at least two balls 30 mounted in the bottom surface 22 and protruding outwardly therefrom as shown in FIG. 4. Each ball 30 is mounted on an axle to revolve only in the direction perpendicular to the hitting surface 27. As such, when utilized by a right-handed or left-handed golfer swinging the putter 10 from left to right and right to left respectively, each ball 30 would roll only from left to right and right to left.

Figure 2:
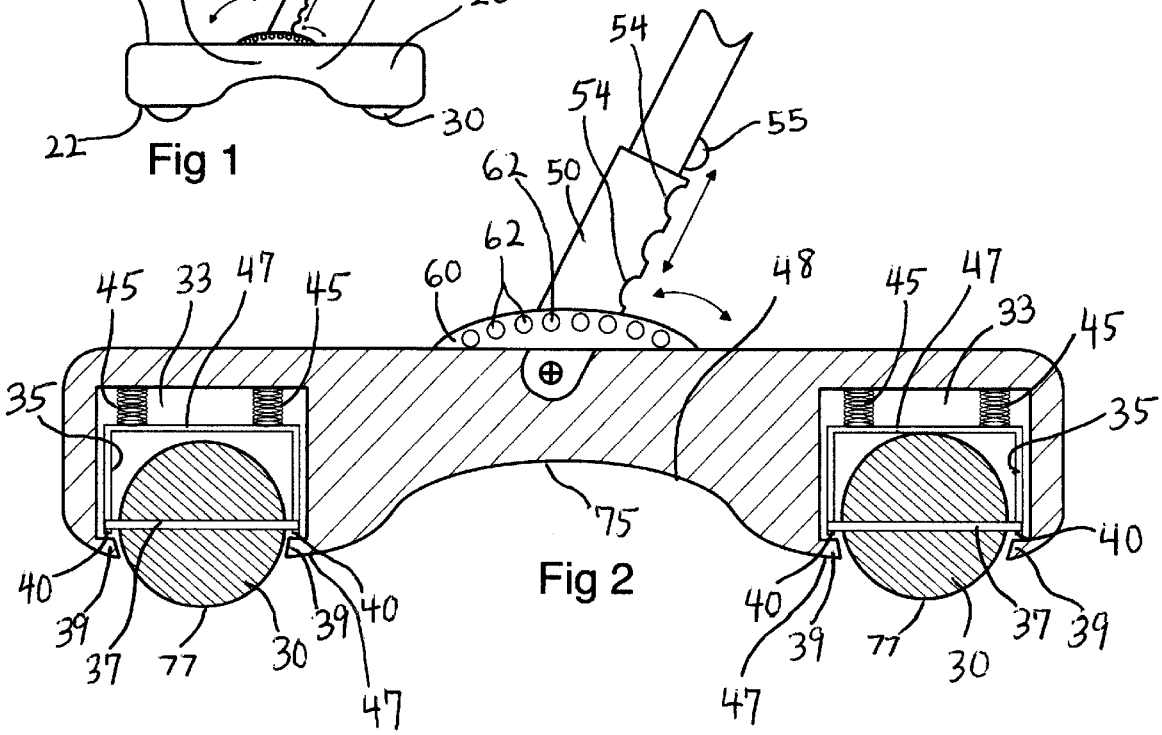
FIG. 2 is a cross-sectional side view of the head and shaft portion of the present invention cut along the A—A line of FIG. 4.

As illustrated in FIG. 2, each ball 30 is mounted in the bottom surface within a chamber 33 defined in the head 20. Each chamber 33 has dimensions predetermined to accommodate a housing member 35. Each housing member 35 has an axle 37 for passing through and rotatably holding a ball 30. Each ball 30 protrudes outwardly from the bottom surface 22 and is prevented from exiting out of the corresponding chamber 33 by a shoulder portion 39 along the edges of the bottom surface 22 at the entrance to the chamber 33 which engages the bottom edges 40 of the corresponding housing member 35. Furthermore, each ball 30 predetermined amount of pressure thereon by a shock system. In the embodiment as shown in FIG. 2, the shock system comprises one or more springs 45 connecting the chamber 33 to the top surface 47 of the corresponding housing member 35. Each spring 45 is biased to urge the housing member 35 away from the chamber 33. In an alternative embodiment not shown, each axle 37 is removably attached to the housing member 35 so that the golfer could use the putter 10 with all of the balls 30 removed should he desire.

As shown in FIGS. 2 and 4, the bottom surface 22 of the head 20 of the present invention has a middle portion 48 which is concave. In the embodiment as shown in FIGS. 2 and 4, each ball 30 is positioned adjacent the opposed ends 47 of the concave middle portion 48.

The putter 10 of the present invention further comprises a means to adjust the length of the shaft 12. In a first embodiment (not shown), the means is a telescopic means whereby a first portion (not shown) of the shaft 12 can slide in and out of a second portion (not shown, of the shaft 12 having a slightly larger diameter. In the embodiment as shown in FIGS. 2 and 4, the means includes a hollow tubular member 50 hingeably mounted in the top surface 25 of the head 20. The tubular member 50 has a diameter larger than the diameter of the shaft 12 for allowing the second end 18 of the shaft 12 to slide in and out of the tubular member 50. A plurality of holes 54 extends through the tubular member 50 for engaging with a semi-spherical member 55 mounted in the second end 18 of the shaft 12. The semi-spherical member 55 is biased to protrude outwardly from the shaft 12 and moves into the shaft 12 with the application of a predetermnined amount of force thereon. A spring loaded means, as known in the art, can be used in mounting the semi-spherical member 55 in the shaft 12. Pushing the semi-spherical member 55 into the shaft allows the shaft 12 to slide in and cut of the tubular member 50, and the shaft 12 locks into the tubular member 50 when the semi-spherical member 55 engages a corresponding hole 54. Thereby, the length of the shaft 12 can be adjusted according to the hole 54 in which the semi-spherical member 55 is set. This feature allows the golfer to adjust the length to the practice putter 10 to that of his game putter.

Figure 3:
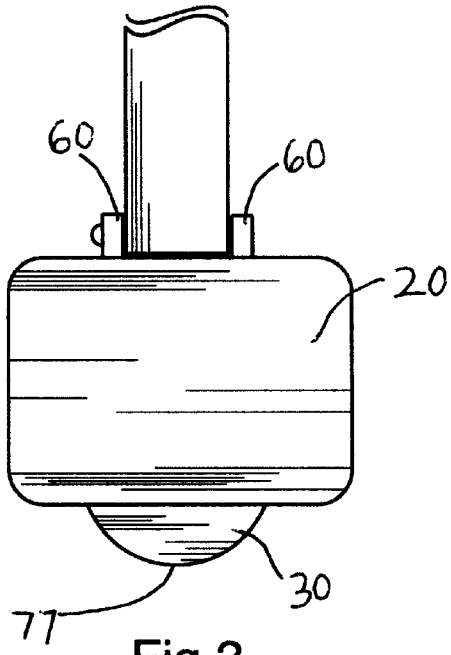
FIG. 3 is a front view of the present invention.

The putter 10 further comprises a means to adjust the shaft-head angle defined by the shaft 12 and the head 20. Such means requires a locking member for locking the tubular member 50 at predetermined angles relative to the top surface 25 of the head 20. In the embodiment shown in FIGS. 2 to 4, one or more plates 60 protrudes outwardly from the top surface 25 of the head 20 and is positioned adjacent the tubular member 50. A plurality of holes 62 arranged in a predetermined arch pattern extends through at least one plate 60. A second semi-spherical member 65 is mounted in the tubular member 50 corresponding to the holes 62 on the plate 60. The second semi-spherical member 65 is biased to protrude outwardly from the tubular member 50 and moves into the tabular member 50 with the application of a predetermined amount of force thereon. A spring loaded means, as known in the art, can be used in mounting the second semi-spherical member 65 in the tubular member 50. Pushing the second semi-spherical member 65 Into the tubular member 50 allows the tubular member 50 to be rotated, and the tubular member 50 can be locked into the desired angle relative to the head 20 by engaging the second semi-spherical member 65 to the corresponding hole 62. Thereby, the angle of the shaft 12 relative to the head 2D can be adjusted according to the hole 62 in which the second semi-spherical member 65 is set. This feature allows the golfer to adjust the shaft-head angle of the practice putter 10 to that of his game putter.

The putter 10 of the present invention further comprises a sight line (not shown) extending along the top surface 25 orthogonal to the striking surace. The sight line assists the golfer to develop a straight putting swing when hitting a target ball. In a putting motion, the sight line should move straight.

The putter 10 assists the golfer develop the ideal flat, straight, sweeping putting swing. In use, the right-handed golfer holds the putter 10 by its grip 16 and swings the head 20 from right to left in order to strike a target ball. Each putter 10 has a "sweet spot" on the hitting surface 27. This is the spot usually on the central portion 70 of the hitting surface 27 that the golfer wants to hit the golf ball with in order to produce the most accurate result. In an ideal put, the "sweet spot" makes contact with the golf ball's center of mass. On the putter 10, the "sweet spot" is centrally located on the hitting surface and corresponds to the deepest concave portion 75 of the bottom surface 22. To properly use the putter 10, it is necessary to roll the head 20 across the putting surface on the freely rotating balls 30. The balls 30 guide the head 20 to move in a straight line. Furthermore, the balls 30 assist the golfer to maintain the head 20 at the proper level above the putting surface. When held above the putting surface, the bottom portion 77 of each ball 30 protrudes approximately ¼" to ⅜" from the bottom surface 22. It is necessary for the golfer to have each surface 22. It is necessary for the golfer to have each ball 30 touch the putting surface and freely rotate in a putting swing. The bottom surface 22 is concave so that if one or more balls 30 is not touching the putting surface as the head 20 strikes the target ball, the golf ball's center of mass will miss the "sweet spot", producing an inaccurate put. The deepest concave portion 75 of the bottom surface 22 is set approximately ¼" to ⅜" from the level of the non-concave portion of the bottom surface 22. Also, the head 20 should be made of a dense and heavy material such as a metal alloy which makes the head 20 relatively heavy compared to the head of a conventional putter. As such, if the golfer does not provide any lift to the head 20 to the desired level, the balls will not support the head 20 at the desired level of ¼" to ⅜" above the putting surface. Instead, if no lift is provided, the weight of the shaft 12 and head 20 on the balls 30 will cause them to press into head 20 causing the head 20 to lie too close to the putting surface and also causing the balls 30 to not roll properly. Providing the right amount of lift to the head 20 to maintain it ¼" to ⅜" off the putting green will allow the balls 30 to roll properly during the entire putting stroke.

To properly utilize the putter 10 of the present invention, the golfer maintains his normal stance and putting motion. In a back stroke (when the head is swung away from the golf ball), the golfer should provide the right amount of lift to the head 20 to allow the balls 30 to maintain contact with the putting green during the entire back stroke. Then in the front stroke (when the head is swung toward the golf ball), the golfer should also provide the right amount of lift to the head 20 to allow the balls 30 to maintain contact with the putting green during the entire front stroke. If done properly, the balls 30 will guide the head to roll in a straight line during both the back stroke and the front stroke. Even though the head 20 is rolling on the balls, the shock system and the rounded bottom shape of the balls 30 help to create a fluid, free-floating swing motion. Although it is preferred that the freely rotating balls 30 maintain contact with the putting surface throughout the back stroke and front stroke, it is understood that in longer putts where the golf ball is far from the target flag, it may be necessary to momentarily lift the balls 30 above the putting surface near the end of the back stroke and for a short time into the forward stroke without loosing much of the advantages of the present putter 10.

When the average golfer properly practices using the practice putter 10, his putting accuracy should be maximized when he switches to his own game putter. Also, by removing the balls 30 by detaching the axles 37, the golfer can use the putter 10 of the present invention as his game putter.

While a preferred embodiment of the invention has been described and illustrated for purposes of clarity and example, it should be understood that many changes, substitutions and modifications to the described embodiment will be apparent to those having skill in the art in light of the foregoing disclosure without departing from the scope and spirit of the present invention which is defined by the claim which will follow.

What is claimed is:

1. An improved putter comprising:

a shaft;

a head connected to said shaft, said head having a hitting surface for striking a golf ball and a concave bottom surface; and, at least two balls mounted in said bottom surface and protruding outwardly therefrom, said balls being mounted to revolve only in the direction perpendicular to said hitting surface.

2. The improved putter as described in claim 1 wherein said balls are mounted to move inwardly with the application of a predetermined amount of pressure thereon.

3. The improved putter as described in claim 1 further comprising a means to adjust the length of said shaft.

4. The improved putter as described in claim 1 further comprising a means to adjust the angle of the connection between said shaft and said head.

5. The improved putter as described in claim 1 further comprising axle means disposed in said head for mounting said balls in said bottom surface.

6. An improved putter comprising:

a shaft having a grip at a first end and connected to a head at a second end;

said head having a top surface, a bottom surface, and a striking surface for hitting a golf ball;

said bottom surface being concave at a middle portion;

a pair of balls mounted in said bottom surface and protruding outwardly therefrom, said balls being mounted to revolve only in the direction perpendicular to said hitting surface; and, each ball being disposed adjacent opposed ends of the concave middle portion.

7. The improved putter as described in claim 6 wherein said balls are mounted to move inwardly with the application of a predetermined amount of pressure thereon.

8. The improved putter as described in claim 6 further comprising axle means disposed in said head for mounting said balls in said bottom surface.

9. The improved putter as described in claim 8 wherein said axle means is removably disposed in said head for removably mounting said balls in said bottom surface.

10. The improved putter as described in claim 6 further comprising:

a hollow tubular member hingeably mounted in the top surface of the head, said tubular member receiving said second end of said shaft; and, a locking member for locking said tubular member at predetermined angles relative to said top surface of said head.

11. The improved putter as described in claim 10 further comprising:

a plurality of holes extending through said tubular member;

a semi-spherical member mounted in said second end of said shaft and biased to protrude outwardly from said shaft;

said semi-spherical member mounted to move into the shaft with the application of a predetermined amount of force;

whereby when said semi-spherical member is pushed into said shaft, said shaft can slide in and out of said tubular member; and, whereby said shaft locks into said tubular member when said semi-spherical member engages a corresponding hole.

12. An improved putter comprising:

a shaft having a grip at a first end and connected to a head at a second end;

said bead having a top surface, a bottom surface, and a striking surface for hitting a golf ball;

said bottom surface being concave at a middle portion and said concave portion extending to said hitting surface to form a concave arch on said hitting surface;

a pair of balls mounted in said bottom surface and protruding outwardly therefrom, said balls being mounted to revolve only in the direction perpendicular to said hitting surface; and, each ball being disposed adjacent opposed ends of the concave middle portion.

13. The improved putter as described in claim 12 wherein said balls are mounted to move inwardly with the application of a predetermined amount of pressure thereon.

14. The improved putter as described in claim 12 further comprising axle means disposed in said head for mounting said balls in said bottom surface.

* * * * *